US007892377B2

(12) United States Patent
Lais et al.

(10) Patent No.: US 7,892,377 B2
(45) Date of Patent: Feb. 22, 2011

(54) DIMENSIONALLY STABLE HORTICULTURAL NETTING

(75) Inventors: Joseph F. Lais, St. Paul, MN (US); Christian E. Siems, Northfield, MN (US); Stephen J. Tillmann, Atascadero, CA (US)

(73) Assignee: Plantra, Inc., St. Paul, MN (US)

( * ) Notice: Subject to any disclaimer, the term of this patent is extended or adjusted under 35 U.S.C. 154(b) by 738 days.

(21) Appl. No.: 11/950,320

(22) Filed: Dec. 4, 2007

(65) Prior Publication Data

US 2008/0134726 A1 Jun. 12, 2008

Related U.S. Application Data

(60) Provisional application No. 60/872,917, filed on Dec. 4, 2006.

(51) Int. Cl.
*B32B 37/00* (2006.01)

(52) U.S. Cl. ..... 156/148; 156/256; 156/264

(58) Field of Classification Search ..... 156/148, 156/256, 264, 244.11, 244.15
See application file for complete search history.

(56) References Cited

U.S. PATENT DOCUMENTS 3,674,898 A * 7/1972 Larsen ..... 264/146
5,104,714 A * 4/1992 Leiber et al. ..... 442/1

* cited by examiner

*Primary Examiner*—Jeff H Aftergut
(74) *Attorney, Agent, or Firm*—Patterson Thuente Christensen Pedersen, P.A.

(57) ABSTRACT

A method of manufacturing a raschel knit net having square meshes is provided. The method consists of providing a raschel knit net having diamond meshes, and cutting diagonally across the net from selvedge to selvedge. Multiple pieces of cut net are rotated and aligned, selvedge to selvedge, such that the meshes are square shaped with the mesh strands running generally lengthwise and widthwise. The aligned selvedges are then joined together, creating a net having square meshes, such that the dimensions of the net are fixed lengthwise and widthwise. The joined selvedges create a dimensional control portion extending diagonally between lengthwise edges of the net.

6 Claims, 10 Drawing Sheets

DIMENSIONALLY STABLE HORTICULTURAL NETTING

RELATED APPLICATION

The present application claims the benefit of U.S. Provisional Application No. 60/872,917, filed Dec. 4, 2006, which is incorporated herein in its entirety by reference.

FIELD OF THE INVENTION

The present invention relates generally to a protective net for horticulture applications. More particularly, the present invention relates to an apparatus, method of installation, and method of manufacture for a protective net.

BACKGROUND OF THE INVENTION

Vineyards and orchards produce valuable fruit for eating and for making wine and other beverages. Particularly when the fruit is ripening it is subject to depredation by birds which can cause not only crop damage, but crop loss. As grapes and fruit ripen and sugar content increases, injured or damaged fruit becomes increasingly susceptible to bunch rot pathogens. The bunch rot complex of fungi and bacteria establish infections most often through a wound on the surface of fruit. These fungi and bacteria are commonly present on soil debris and many plant surfaces, including the fruit itself. Because of the close proximity of pathogens to fruit, the rot process can begin almost as soon as the skin of the grape is compromised. Any injury to the skin of ripening berries, grapes or other fruit from large to very small, is a potential entry point for these pathogens causing infection on the damaged fruit which can and does spread to adjacent otherwise undamaged fruit.

In the case of wine or table grapes, "bird peck" damage can be very costly, one grape with broken skin can lead to a fungal infection and loss of the whole grape cluster. It is difficult and thus relatively expensive to cull rotting grapes; such culling almost always necessitates removal of the infected grape cluster. There are two typical methods of culling, field culling from the vine and conveyor culling at the winery, both cumbersome and labor intensive. For grapes that are machine harvested, culling is not possible once the harvester removes the fruit and mixes the affected grapes in large gondolas that can hold tons. In such a case, a small amount of bird peck induced rot can cause large-scale crop rejections by the fruit buyer and or winery resulting in a severe economic loss to the grower.

Such bird induced damage to fruit can be reduced or prevented by a number of methods include killing the birds, scaring away the birds, trapping the birds, and providing barriers between the fruit and birds. Killing the birds is typically illegal and inhumane. Falconry, propane cannons, and passive means such as flash tape or balloons are utilized to scare the birds. If at all successful, these methods often only serve to temporarily move the birds to another location. Similarly, trapping the birds and temporarily removing them from the area has not proven effective.

Net-type barriers can offer complete and continuous barrier protection twenty four hours a day. With respect to vineyards, where grapes are grown in rows with multiple vines supported by trellis', the netting is typically utilized in one of three ways: 1) by draping netting over single or multiple rows of vines, 2) by securing netting in narrow panels along the sides of trellis rows to protect only the zone of the vine that bears fruit, or 3) by suspending the netting from a permanent overhead structure.

The most common method is to lay a net over the vine canopy, that is, simply over the entire vine. The efficiency of this method is facilitated by the great number of widths available, particularly for knitted nets. Such nets can cover two, three, four or more rows in one pass.

Growers who want to avoid covering the entire canopy with net can instead install narrow nets at the side of the canopy to cover the fruit zone. This practice is labor intensive, particularly where such installation and removal occurs annually. Such side net must be physically attached to the trellis that supports the row of vines at multiple points which greatly increases installation and removal costs.

Nets can also be used in constructing bird exclosures. Bird exclosures require a permanent support structure of posts and wires than can interfere with the functioning of other critical vineyard equipment such as harvesting machines. Exclosures also necessitate the use of heavier and more expensive netting.

There are four common types of netting used: extruded, warp knitted, and knotted or multi-filament knotless. One common type of modern commercial bird net is made as a single piece by extrusion. The resulting extruded net is stiff and has sharp edges requiring that workers wear leather gloves when working with it. Extruded net is stiff and has a property known as shape memory. Shape memory makes it difficult to pull the net in place. It must be manually secured below the fruiting zone, or it will revert to its original shape, lifting away from the fruit and allowing entry by birds from below.

The width of extruded net is limited to the width of the extrusion tooling. Extruded net is made in such a way that it generally must all be the same color, eliminating the potential for colored markers to be included in the manufacture of the net. Such colored markers can facilitate installation and removal by providing reference lines for positioning feedback when installing the net. The absence of such markers makes it hard to center the net over the canopy. Similarly, the edge cannot be made a contrasting color to make it easy for a worker to locate the edge. Extruded nets are handled on rolls, which are heavy; installation and removal require the use of heavy, expensive and potentially dangerous hydraulic equipment.

Extruded net offers the advantage that its dimensions are fixed; it cannot be stretched and therefore cannot be installed with the incorrect length or width.

Knitted net is more flexible than extruded net. A common form of knitting is warp knitting, with raschel knit being a class of fabrics of the warp type. Warp knits are characterized by the yarns, or threads, being formed into stitches in a lengthwise direction. Warp knitted net made from high density polyethylene, polypropylene, or nylon is supple and drapes easily in place. Such knitted netting does not have any shape memory, so it hangs all the way down to the ground protecting the vine, and in many applications does not need to be secured, unlike extruded net. Further, knitted net is soft to the touch and does not have sharp corners or edges to cut the hands of workers, so workers do not need gloves to protect their hands. Most single or double knitted net can be installed and retrieved with an inexpensive non-hydraulic applicator.

The same warp knitting machine can produce net from 1 foot to 100 feet wide. Warp knitted net is made with a wide variation in thread "denier" to create heavier or lighter weight nets. Further, warp knitted net has a rip-stop property, in that small tears caused by vineyard posts or other means do not propagate through the material.

Knotted and multi-filament knotless forms of net are highly effective alternatives to knitted and extruded net. Generally, these are used in permanent installations to create bird exclosures. The main disadvantage of knotted and knotless nets is their high cost.

Referring now to raschel knitted diamond or hexagonal mesh net, as currently manufactured this net is stretchy, or more precisely it is not dimensionally stable in either the lengthwise or widthwise direction. For example, when such a net is pulled lengthwise, the meshes in the net will deform and become long and narrow resulting in a narrowing of the potential width of the net. When the net is pulled tight, in the longitudinal direction, the meshes will essentially be closed; this defines the rope length of the net. The rope length can refer to the entire length of the net, for example 150 meters, or can refer to a unit length by reference to mesh opening density, for example 48 aligned openings per meter. Each of such nets have a "design" size where the individual openings defined by the meshing have the optimal size, which would normally be at or about the maximum opening area. The design size would have a design length, which can be stated as the entire length of the net, for example 100 meters and a design width, for example 5 meters, which would normally be at or about the labeled length and width assigned to the net by the manufacturer and put on the net packaging. The design length may also be stated in a unit length by reference to mesh opening density, for example, 32 aligned openings per meter.

Referring to FIG. 1, there can be seen a partial view of a prior art knitted net in a slack position with the meshes at approximately their optimal size. FIG. 1A shows a prior art net under tension in a lengthwise direction E such that the border rope is pulled taught and thus linear, the meshes are not of optimal size. As can be seen in FIGS. 1 and 1A, when the net is subjected to tension in the direction of arrow E, a dimension B, the width of the "square" or meshes is reduced to a dimension D. Further, a dimension A, the length of the meshes, is increased to a dimension C when under tension in the direction of arrow E. The dimensions of the individual meshes of course correspond to the length and width of the net when the meshing positioning is uniform. In such prior art netting there is no easy indicator as to the proper lengthwise tension or stretch to apply to the netting. The easiest stretch length is the taught "rope" length of the border bundle of meshes which results in a net stretched lengthwise more than the optimal "design" length and size.

When this type of net is installed, as the net is laid down over the canopy of trees or bushes (i.e., blueberries), vines or other crops (i.e. strawberries), the meshing immediately becomes engaged with the leaves and branches effectively preventing any longitudinal or lateral adjustment of the positioning of the net on the canopy. Thus, the net has to be close to its "design" size as it is deployed. Deployment in the design size is dependent primarily upon tension the net is under primarily in its longitudinal direction, but also in its widthwise direction as it is being deployed. Moreover, the balance between these forces directly impact the dimensions of the net as it is deployed. The balance or differences between these forces may vary dramatically along the length of the net such that the net is excessively wide along certain portions of the row of crops and excessively narrow along other portions.

This lack of dimensional stability makes it very difficult to simultaneously deploy or apply a knitted net in its design size, that is, both the correct length and correct width dimensions that would typically be marked on the label of the net. Workers installing the net attempt to apply the correct tension in the lengthwise and widthwise directions in order to achieve proper coverage of the net. Some nets include colored indicator lengthwise stripes to assist in installation. When the net is properly installed, the stripes will be a predetermined distance apart. However, this can be a slow and cumbersome process, particularly to repeatedly monitor the spacing to properly install the net.

The problems associated with installing current nets are most acute when the installation process places either excess or insufficient tension in the warp direction, that is, the lengthwise, direction. When over-stretched lengthwise, the net cannot be stretched widthwise to the dimension as marked on the label. The net will be too long in the lengthwise direction, and too short in the widthwise direction. Conversely, if workers under-compensate and place too little tension on the net in the lengthwise direction, the net will be too short in the lengthwise direction, and too long in the widthwise direction relative to the design size. As a result, nets would need to be sized larger than what is actually needed for the installation, to compensate for the less than optimal installation of the net. This can mean unnecessary higher costs for the nets.

There exists a need then for a net to protect fruit from bird damage that is inexpensive, and has ready guidance for optimal installation, that has rip stop construction, and that is supple and easily draped over fruit-bearing plants.

SUMMARY OF THE INVENTION

The present invention substantially meets the aforementioned needs of the industry. In one example embodiment, the present invention comprises a raschel knit elongate net having square patterned meshes in alignment with the length of the net. Mesh strands of the net are oriented to run parallel and perpendicular to the edges of the elongate net, whereby the net is dimensionally stable in both the lengthwise and widthwise directions when it is dispensed on crops.

In a preferred embodiment, the present invention comprises a method of manufacturing a raschel knit net having square meshes. The method comprises providing a stream of raschel knitted net having diamond meshes, and cutting diagonally across the net from the edge or selvedge to the opposite edge or selvedge to form net segments. The segments can be triangles or parallelograms or perhaps other shapes joined edge to edge such that the mesh strands are lengthwise and widthwise with respect to the elongate stable net.

In certain embodiments, multiple pieces of cut net segments are rotated and aligned, selvedge to selvedge, such that the meshes are square shaped with the mesh strands running generally lengthwise and widthwise. The aligned selvedges are then joined together, creating a net having square meshes, such that the dimensions of the net are fixed lengthwise and widthwise. The joined selvedges create a dimensional control portion extending diagonally between lengthwise edges of the net.

In another preferred embodiment, the stream of raschel knitted netting is wrapped, folded, or wound in a spiral manner such that a first edge is continuously abutted to a second edge in a helix. The adjoining edges may be joined and the resulting tubular netting may be split lengthwise in alignment with the meshes to create a single rectangular elongate length of netting. In this fashion, a limitless length of netting can be formed without ever cutting off discrete sections or pieces of the netting.

It is an advantage of the present invention that the net will retain its manufactured dimensions when installed. It is a further advantage of the present invention that the net may be installed faster, due to the net retaining the correct dimensions when being pulled and secured into place.

A still further advantage of the present invention is that less material is needed to create a net that covers the same area than is currently possible. Because the net retains its dimensions when installed, the net no longer must be manufactured larger than needed to compensate for stretching and distortion that used to frequently occur during installation.

The above summary of the various embodiments of the invention is not intended to describe each illustrated embodiment or every implementation of the invention.

This application solves some of the problems identified in PCT Patent Application for HORTICULTURAL NETTING WITH DIMENSIONAL CONTROL, Publication No. PCT/US2006/044885, which is incorporated by reference herein.

The Figures in the detailed description that follow more particularly exemplify these embodiments.

BRIEF DESCRIPTION OF THE DRAWINGS

The present invention can be more completely understood and appreciated by referring to the following more detailed description of the presently preferred exemplary embodiments of the invention in conjunction with the accompanying drawings, of which.

DETAILED DESCRIPTION OF THE DRAWINGS

In the following detailed description of the present invention, numerous specific details are set forth in order to provide a thorough understanding of the present invention. However, one skilled in the art will recognize that the present invention may be practiced without these specific details. In other instances, well-known methods, procedures, and components have not been described in detail so as to not unnecessarily obscure aspects of the present invention.

Figure 1:
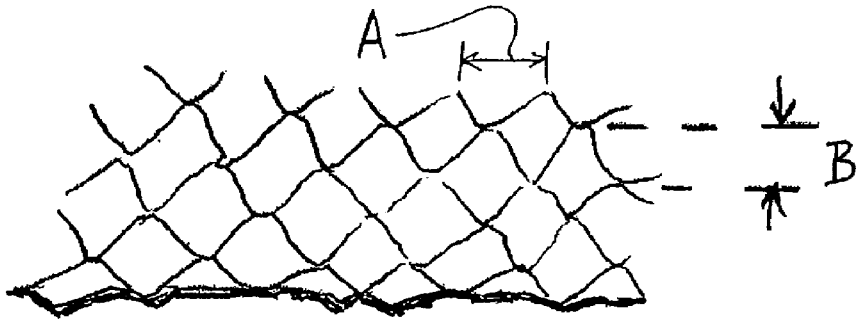
Fig. 1 PRIOR ART
FIG. 1 is a view of a prior art net.
Figure 1A:
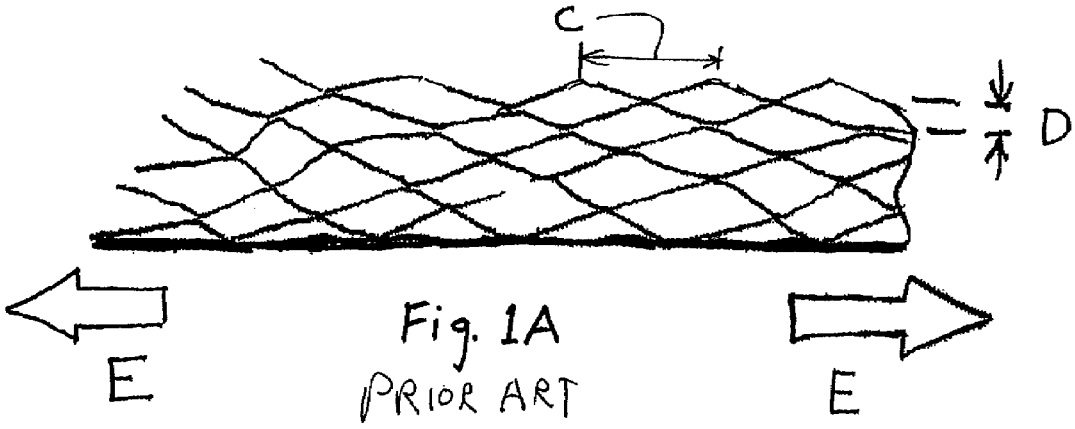
Fig. 1A PRIOR ART
FIG. 1A is a view of a prior art net.
Figure 2:
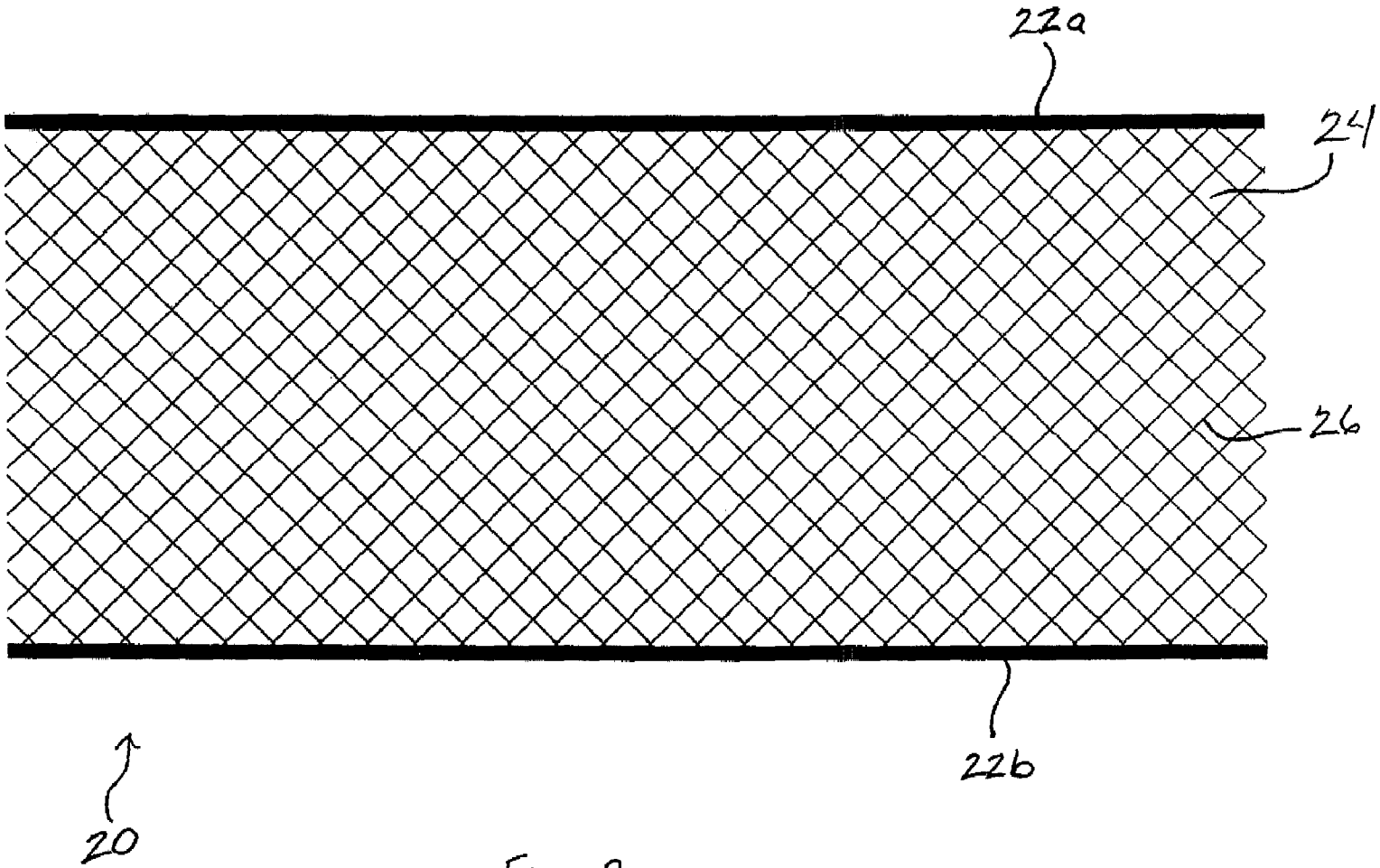
Fig. 2 PRIOR ART
FIG. 2 is an plan schematic view of a knitted net having diamond-shaped meshes.
Figure 2A:
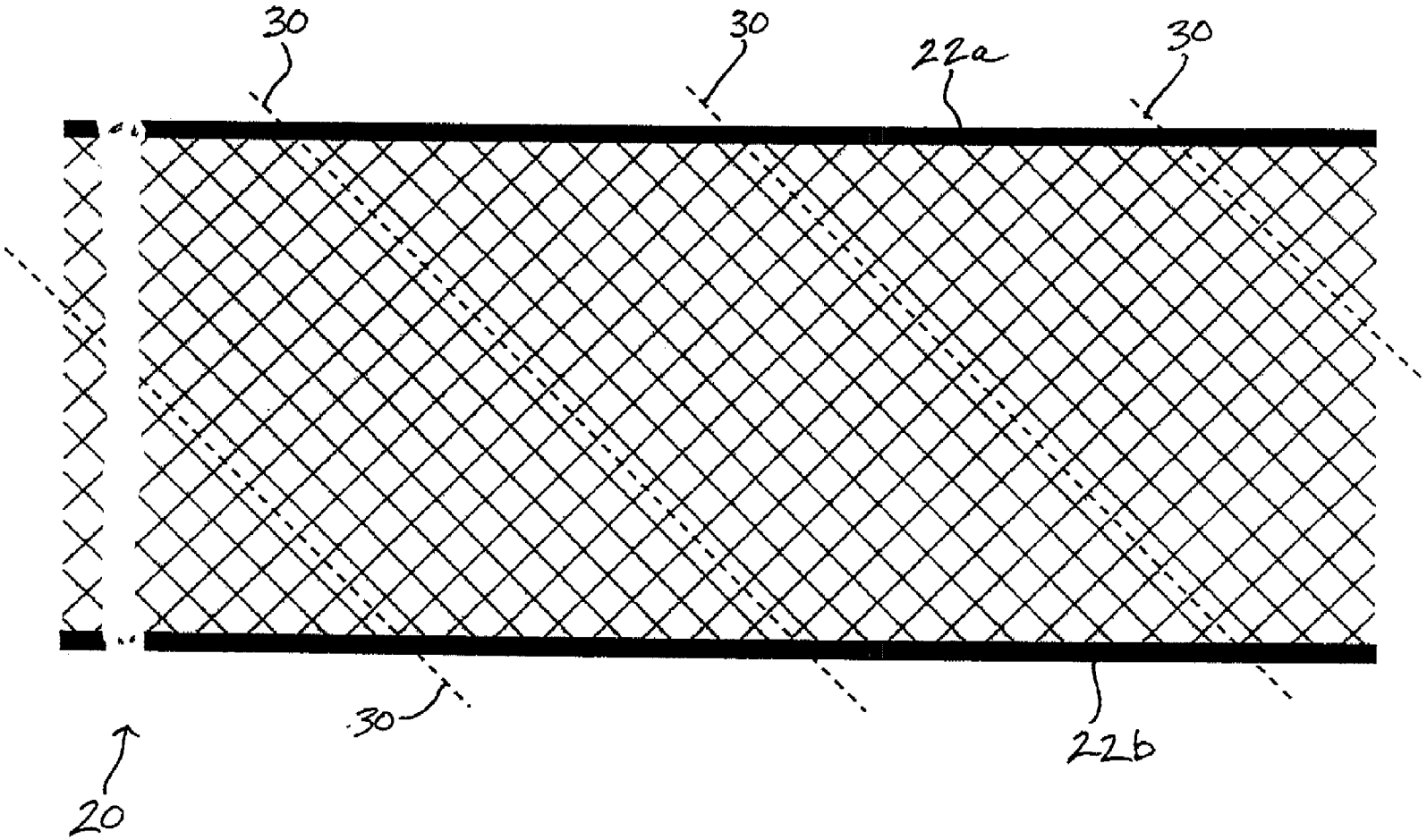
FIG. 2A is the net of FIG. 2, illustrating cutting lines according to an example embodiment of the present invention.

In one embodiment, the present invention comprises a method of making a dimensionally stable knitted net from a dimensionally unstable knitted net. The method is as follows. Referring to FIGS. 2-2A, a knitted monofilament net 20 is depicted. Knitted net 20 is dimensionally unstable, such that by pulling lengthwise or widthwise on the net, its shape and dimensions can be changed. In one embodiment, net 20 comprises a raschel-type knitted net. Net 20 is preferably constructed of monofilament yarns, although multifilament yarns may also be used. Ideal materials for the yarns includes polyethylenes, such as high density polyethylene, as well as other materials apparent to one skilled in the art. Net 20 includes a first selvedge 22*a* and a second selvedge 22*b* on either lengthwise edge of a body portion 24. Body portion 24 includes diamond-shaped meshes 26. Each selvedge comprises one or more rows of "closed" meshes. Selvedges may be colored differently than body portion 24 to easily identify the edge of net 20. FIG. 2A depicts example cut lines 30, the location of which may be adjusted or varied depending on the desired application.

Figure 3:
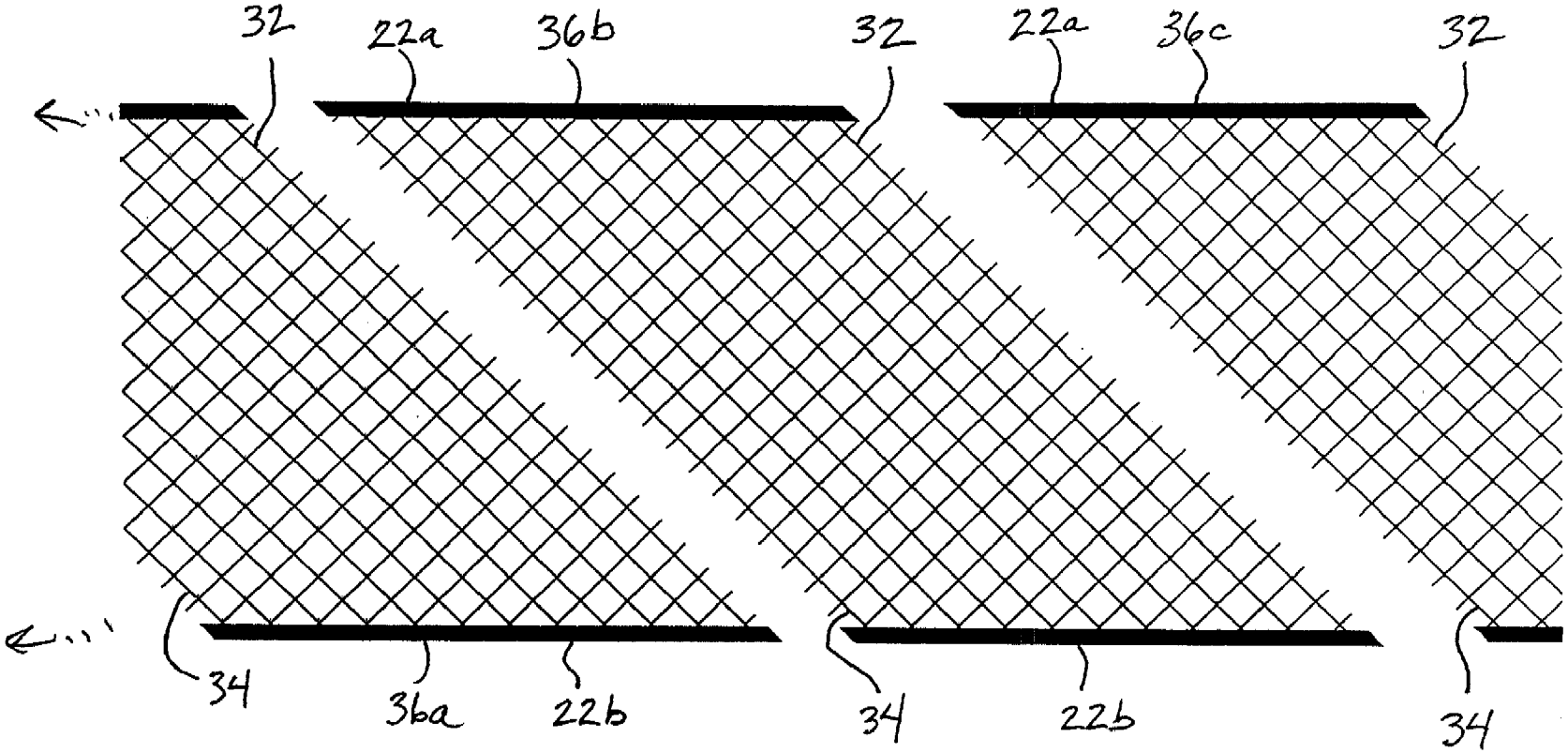
FIG. 3 is an plan schematic view of parallelogram panels according to an example embodiment of the present invention.

Referring now to FIG. 3, net 20 is depicted after being cut along the cut lines, resulting in multiple parallelogram panels 36, shown as panels 36*a*, 36*b*, and 36*c*. Net 20 is cut into panels 36 along its entire length, and can be cut by hand or by machine. Each panel 36 includes a first cut edge 32 and a second cut edge 34. Due to the nature of the construction of knitted nets, the yarns will not unravel after the meshes are cut.

Figure 4:
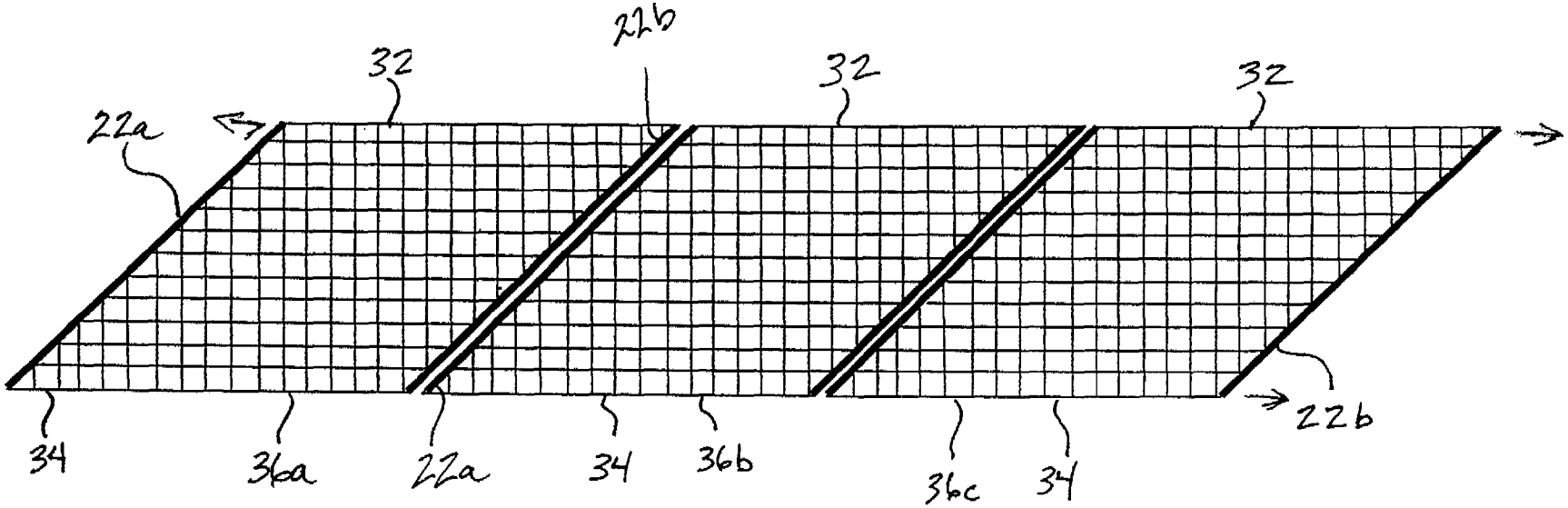
FIG. 4 is an plan schematic view of a knitted net having square-shaped meshes being made according to an example embodiment of the present invention.
Figure 6A:
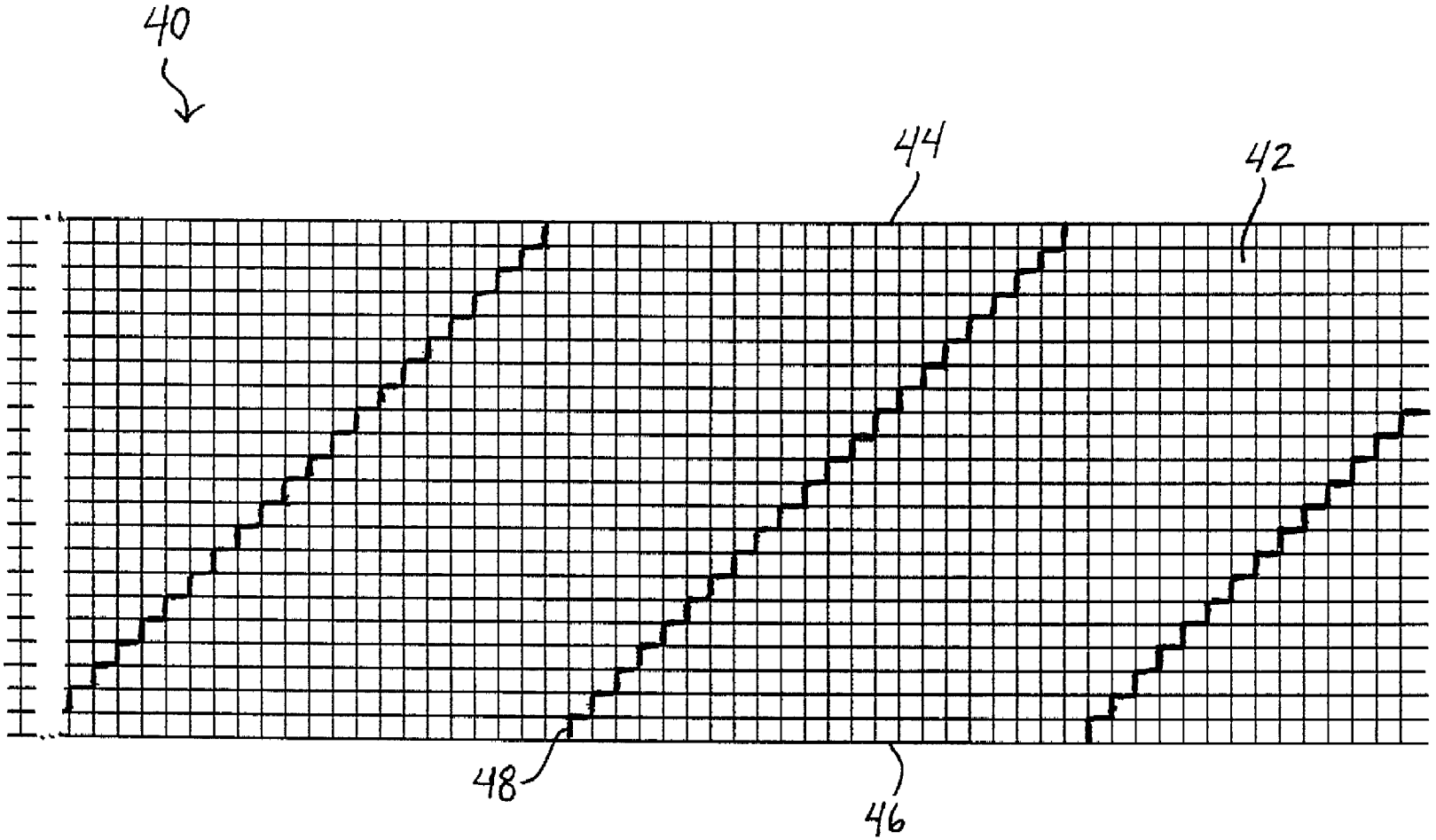
FIG. 6*a* is a view of a knitted net with square meshing as provided by the invention.

Referring now to FIG. 4, each parallelogram panel 36 from FIG. 3 has been rotated forty-five degrees clockwise. As can be seen, the meshes are square shaped, with the mesh strands being oriented lengthwise and widthwise. Each cut edge 32 and 34 now form lengthwise edges. Further, the selvedges 22*a* and 22*b* of each panel 36 are aligned and proximate the selvedges of adjacent panels 36. For example, selvedge 22*b* of panel 36*a* is adjacent and proximate selvedge 22*a* of panel 36*b*. Each panel can then be sewn or otherwise coupled to an adjoining panel to create a net 40 as depicted in FIG. 6*a*. The desired width of net 40 is determined by the spacing of cut lines 30 on net 20. The greater the spacing between cuts, the wider net 40 will be.

Figure 5:
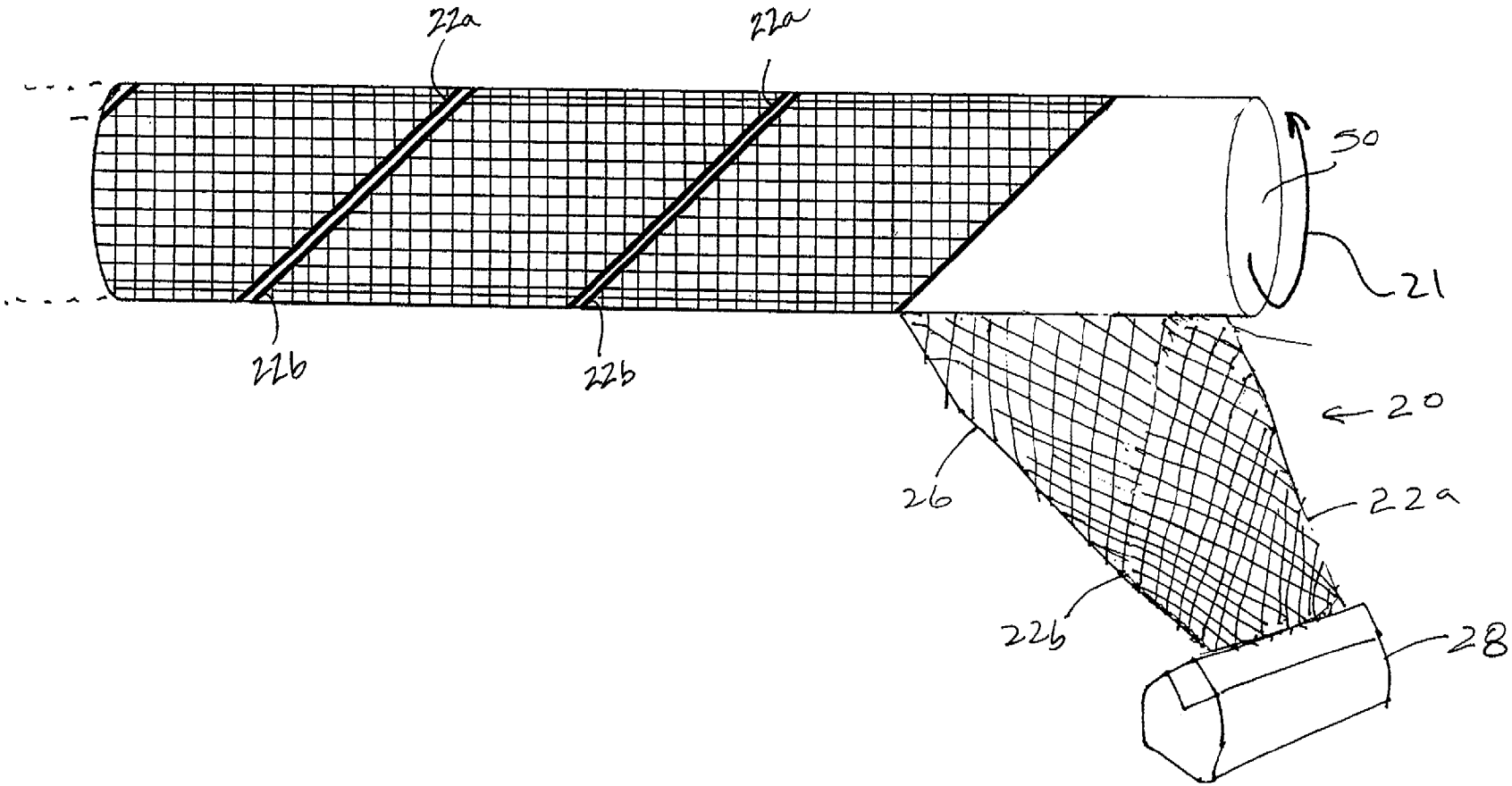
FIG. 5 is a perspective view of an arrangement to convert a knitted net having diamond-shaped meshes to a net having square-shaped meshes according to an example embodiment of the present invention.
Figure 6B:
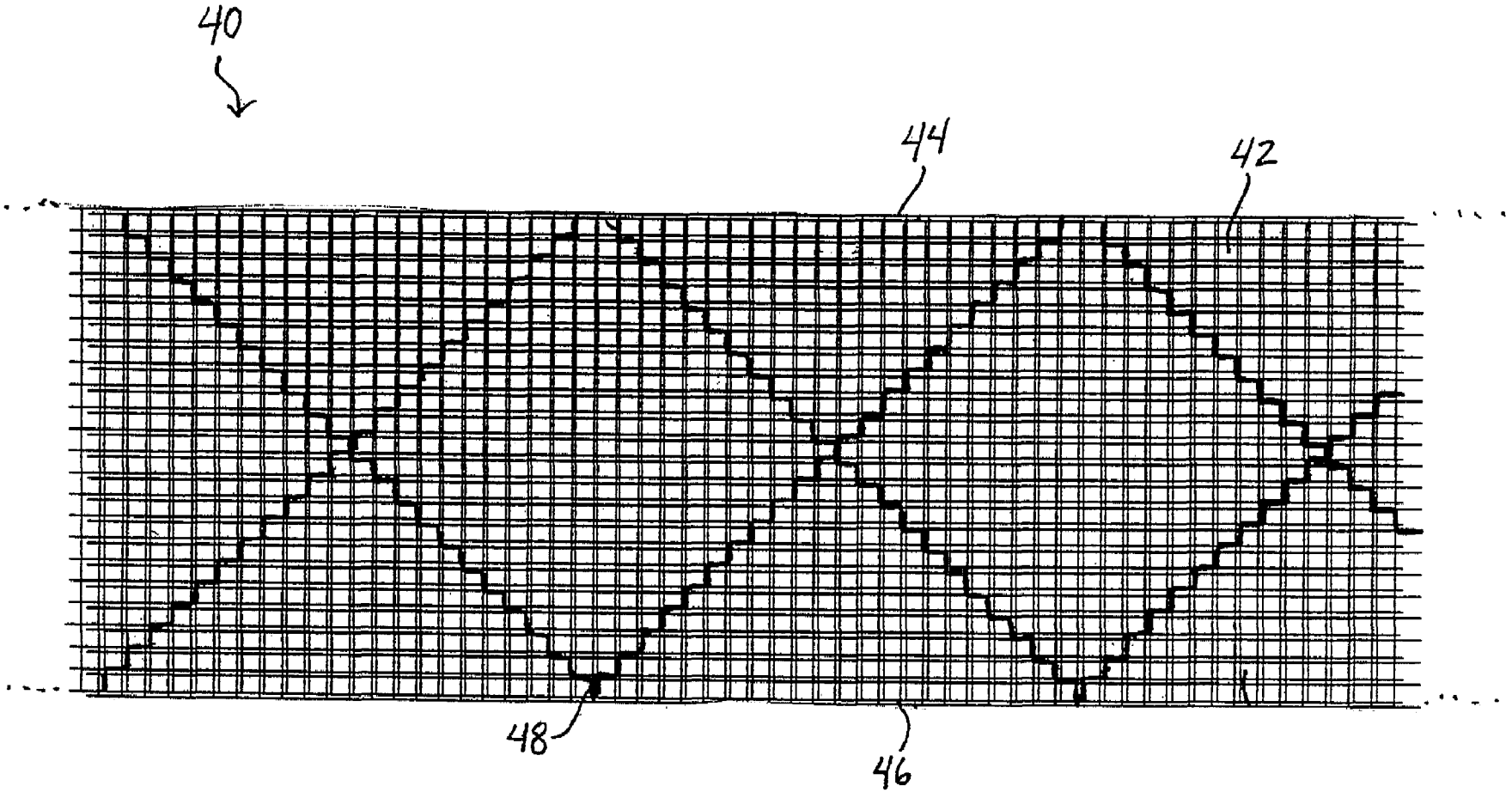
FIG. 6*b* is an view of a knitted net having double layer in a tubular configuration such as produced by the process of FIG. 5.

Referring to FIG. 5, in another embodiment of the present invention, net 20 is fed onto an apparatus to facilitate making a dimensionally stable net. The stream of netting from the knitting machine 28 has the meshing elongate, with the width and length near rope length at discharge. Net 20 is preferably spread out and wrapped around a cylindrical apparatus in a spiral or helix configuration with the cylinder rotating as indicated by arrow 21, such that selvedges 22*a* and 22*b* are helically aligned. The edges are joined resulting is a tubular or double layered net as illustrated in FIG. 6*b*. The net 20 can then be cut in the lengthwise direction of tubular net 40, resulting in the elongate net 50 of FIG. 6*c*. Such net has multiple prejoined parallelogram panels similar to those depicted in FIG. 4 but has advantages in automated manufacture and handling of the net. If the netting is cut while the cylinder is rotating, it will be recognized that the cutting point will be rotating with the cylinder in that such lengthwise cut needs to be along a single row of meshes in an axial direction with respect to the tubular net form and the cylinder.

Figure 6C:
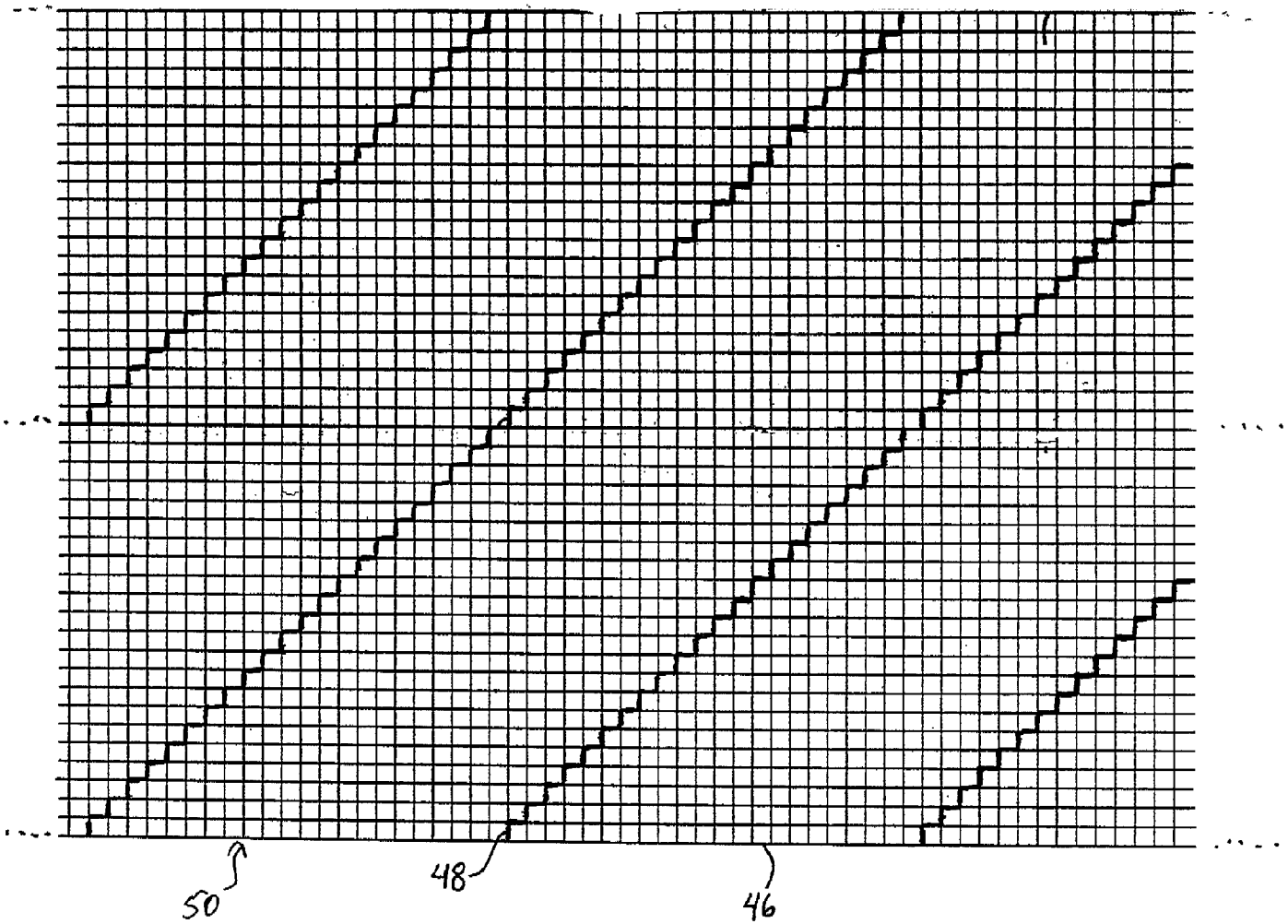
FIG. 6*c* is a view of the knitted net of FIG. 6*b* that is slit lengthwise to produce a net of limitless length having square meshes according to the present invention.
Figure 7:
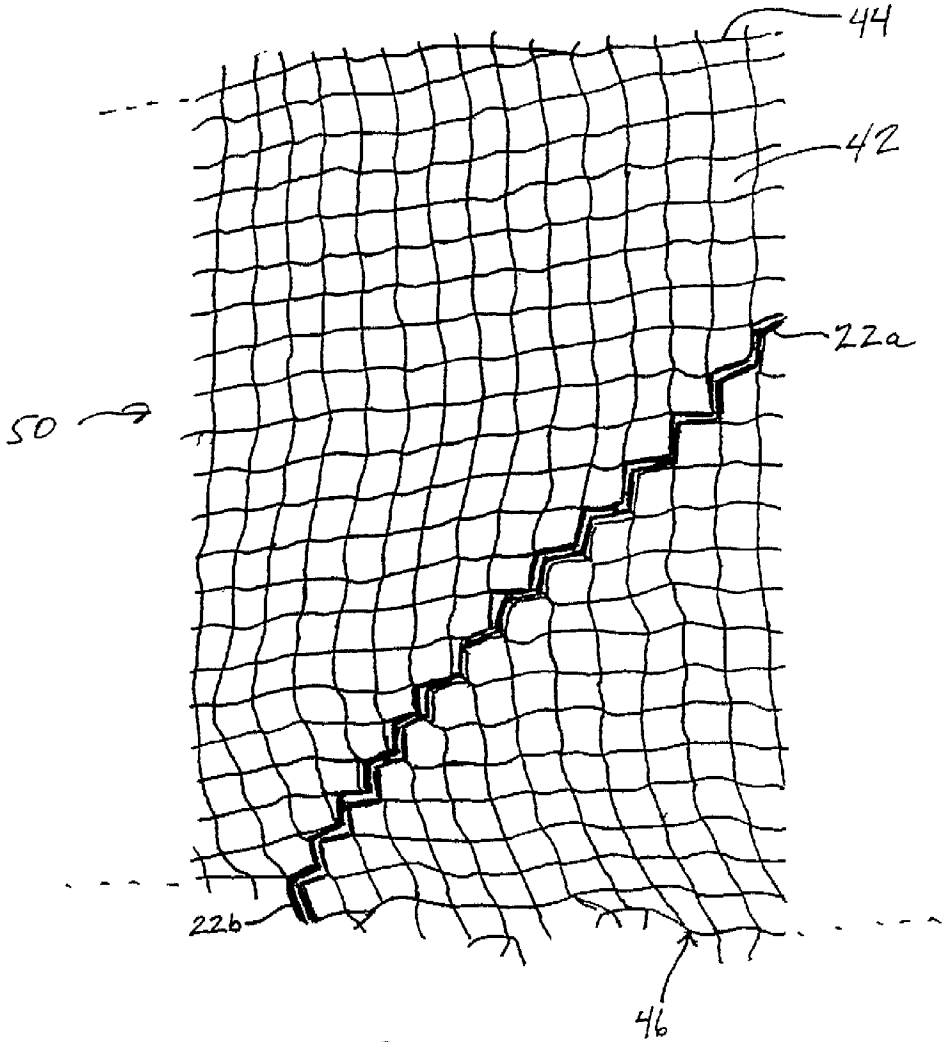
FIG. 7 is a close-up view of a knitted net having square meshes according to an example embodiment of the present invention.

Referring now to FIGS. 6 and 7, details of a square mesh net 50 is depicted. Net 50 may be constructed by way of the methodology depicted in FIGS. 2-4 or as depicted in FIGS. 5, 6*b*, and 6*c*. Net 50 includes square meshes 42, a first edge 44 and a second edge 46, and joined edges 48. It will be appreciated that first edge 44 was first cut edge 32 of net 20, and second edge 46 was second cut edge 34 of net 20. It will also be appreciated that joined edges 48 comprise selvedges 22*a* and 22*b*. Knitted square net 40 is dimensionally stable in the lengthwise and widthwise directions due to the mesh strands being aligned in those directions, Although the present invention has been described with reference to particular embodiments, one skilled in the art will recognize that changes may be made in form and detail without departing from the spirit and scope of the invention. Therefore, the illustrated embodiments should be considered in all respects as illustrative and not restrictive.

What is claimed:

1. A method of manufacturing a longitudinally stable mesh netting comprising the steps of:

discharging a longitudinally unstable mesh netting stream wherein the longitudinally unstable mesh netting stream has a first pattern of meshes formed by a first set of parallel strands and a second set of parallel strands, the first and second sets of parallel strands being diagonally disposed intermediate first and second outer stream edges;

cutting the longitudinally unstable mesh netting stream along diagonal lines with respect to the first and second outer stream edges to form netting segments;

serially adjoining the netting segments with the first set of parallel strands oriented longitudinally to form the longitudinally stable mesh net.

2. The method of claim 1, further comprising the step of adding selvedges to the edges of the longitudinally unstable mesh netting stream before cutting the stream.

3. The method of claim 1, wherein the longitudinally stable net after adjoining the netting segments has edge portions and the method further comprises the step of adding selvedges said edge portions.

4. The method of claim 3, further comprising the step of raschely knitting the longitudinally unstable mesh netting stream.

5. The method of claim 1, further comprising the step of raschely knitting the longitudinally unstable mesh netting stream.

6. A method of manufacturing a longitudinally stable mesh comprising the steps of:

providing a longitudinally unstable mesh netting stream wherein the longitudinally unstable mesh netting stream has a first pattern of meshes formed by a first set of parallel strands and a second set of parallel strands, the first and second sets of parallel strands being diagonally disposed intermediate first and second outer stream edges;

cutting the longitudinally unstable mesh netting stream along diagonal lines with respect to the first and second outer stream edges to form netting segments;

serially adjoining the netting segments with the first set of parallel strands oriented longitudinally to form the longitudinally stable mesh net.

* * * * *